US005311751A

United States Patent [19]

Winter et al.

[11] Patent Number: 5,311,751

[45] Date of Patent: May 17, 1994

[54] CONTROL ARRANGEMENT FOR WARP KNITTING MACHINE GUIDE BARS

[75] Inventors: Karl Winter, Obertshausen; Hans Lotz, Muhlheim/Main; Friedrich Gille, Obertshausen, all of Fed. Rep. of Germany

[73] Assignee: Karl Mayer Textilmaschinenfabrik GmbH, Obertshausen, Fed. Rep. of Germany

[21] Appl. No.: 60,307

[22] Filed: May 10, 1993

[30] Foreign Application Priority Data

May 13, 1992 [DE] Fed. Rep. of Germany ..... 4215716

[51] Int. Cl.[5] ..... D04B 23/00; G06F 15/46

[52] U.S. Cl. ..... 66/207; 66/203; 364/470; 318/41

[58] Field of Search ..... 66/157, 165, 203, 204, 66/207; 364/470, 167.01; 378/41, 51

[56] References Cited

U.S. PATENT DOCUMENTS 4,614,095 9/1986 Porat ..... 66/207

FOREIGN PATENT DOCUMENTS 2349931 9/1974 Fed. Rep. of Germany ..... 66/204
256882 5/1988 German Democratic Rep. ... 66/203
1156559 6/1989 Japan ..... 66/203
8501527 4/1985 PCT Int'l Appl. ..... 66/207

*Primary Examiner*—Clifford D. Crowder
*Assistant Examiner*—John J. Calvert
*Attorney, Agent, or Firm*—Omri M. Behr; Matthew J. McDonald

[57] ABSTRACT

A control arrangement for displacing the guide bar in a warp knitting machines comprises an input arrangement for the setting certain characteristic data defining the desired shogging pattern. There is also provided a first storage section for storing data for various transition curves also relating to shogging patterns. A computer can generate a continuous displacement function based on the characteristic data and the transition curves. An output arrangement can reads out the values of the displacement function in dependence upon the rotation angle position of the main shaft 7 of the knitting machine. The values this read out are used as position target values for the guide bar. This enables flexible adaptation to produce very different patterns in high machine speed.

19 Claims, 2 Drawing Sheets

CONTROL ARRANGEMENT FOR WARP KNITTING MACHINE GUIDE BARS

BACKGROUND OF THE INVENTION

1. Field of the Invention

This invention is directed to a control arrangement for the displacement of guide bars in warp knitting machines having a schedule transmitter that generates a position target value for a displacement pattern in dependence on the angular position of the machine main shaft, for the purpose of controlling a setting motor for axially displacing the guide bars.

2. Description of Related Art

In an arrangement of this type known to the art (DE OS 225 72 24), the appropriate displacement steps to be taken are read from a schedule carrier, for example, a punched or magnetic tape. A synchronizing transmitter generates a signal at predetermined angular positions of the main shaft. This ensures that with the assistance of a position control circuit, the last read displacement step is carried out by means of another schedule carrier. The pattern of the knitted fabric which is formed by the displacement movement may be altered by means of another schedule carrier. The progress of the displacement movement cannot be regulated. It depends entirely on the design of the control circuit. Thus, considerable accelerations and decelerations occur and so the working speed of the warp knitting machine is limited. A further disadvantage of this uncontrolled movement lies in the fact that collisions of the guides with other operating parts can occur, for example, with slider needles during the overlap.

Accordingly there is a need for a control arrangement of the aforementioned type for providing different displacement patterns and which is very flexible and may operate at high speeds.

SUMMARY OF THE INVENTION

In accordance with the illustrative embodiments demonstrating features and advantages of the present invention, there is provided a control arrangement for the displacement of a guide bar of a warp knitting machine having a main shaft. The control arrangement has a setting motor for axially displacing the guide bar. Also, a schedule transmitter is coupled to the main shaft for generating target lapping values for a displacement schedule, in response to angular displacement of the main shaft. This schedule transmitter is coupled to and operable to control the setting motor in accordance with the target lapping values. The schedule transmitter includes: (a) an input arrangement, (b) a storage means, (c) a computer means, and (d) an output arrangement. The input arrangement can provide a characteristic signal signifying characteristic data for a selected lapping pattern. The storage means has a first storage section for storing data signifying a selectable plurality of transition curves for regulating overlap and underlap displacements. The computer means is coupled to the first storage section and is responsive to the characteristic signal for processing sequentially data of at least two of the transition curves to form a displacement function providing displacement values related to revolution of the main shaft. The output arrangement is coupled to the main shaft and the computer means for selecting the displacement values of the displacement function in response to angular rotation of the main shaft to provide the target lapping values.

In a preferred embodiment, an operator can use a computer terminal to set up the input arrangement of the schedule transmitter, which then determines the characteristic data of a desired lapping pattern. The preferred first storage section can store a plurality of transition curves serving as prototypes for the overlap and underlap displacement. The preferred computer means can assemble a continuous displacement function by sequentially generating, for each main shaft rotation, at least two transition curves in dependence upon the operator-selected characteristic data. The preferred output means can issue values from this displacement function in dependence on the angular rotation of the main shaft, which values serve as position target values for the guide bar.

In such an arrangement, the guide bar is controlled continuously. For every instant of the working cycle, a particular position of the guide bar is prescribed according to the particular rotational angle of the main shaft. By utilizing the prototype transition curves, minimal accelerations and decelerations can be ensured during the displacement movement, with the consequence that high working speeds may be obtained. The use of various combinations from a plurality of prototype transition curves allows a selection for optimizing the displacement movement for the desired pattern. Such optimization, in turn, allows consideration of properties other than the displacement pattern, such as pile formation, weft thread provision, pile sinker influence and the like.

Since the transition curves can be used in different combinations, one may operate with a relatively small number of transition curves. The first storage section can thus be relatively small. The selected characteristic data fixes the transition curves to be utilized. Thus the service technician can quite simply institute a pattern change, by merely supplying certain characteristic data to the input arrangement.

The use of a computer enables not only digital processing of the stored data, but also facilitates use of one and the same transition curves with different sign prefixes for opposing displacement movements.

It is particularly desirable that a second storage arrangement stores at least one compensation curve for determining the compensation for the specific mechanical link to the guide bar. For example, the arrangement can compensate for the displacement errors when a jointed push rod is used between the setting motor and the guide bar. The uncompensated use of such a push rod can lead to an unwanted axial displacement of the guide bar when the bar swings, throughout the underlap and the overlap positions. This unwanted axial displacement can lead to collisions with the needles. These collisions can be prevented by utilizing the compensation curve. The computer creates a displacement function by adding or subtracting this compensation curve.

It is advantageous to have a third storage section which stores correction values corresponding to the needle or guide deflection due to thread forces. The computer utilizes these deflection correction values in conjunction with characteristic data (set by the operator's computer terminal, for example) to form the bar displacement function. Since in a given pattern, the thread forces are known, when characteristic data is supplied the computer can take into account the needle/guide defection.

It is advantageous to provide that at least one of the storage arrangements are interchangeable read only storage means, for example EPROMS. By exchange of such storage means, the control arrangement can be readily adapted to another warp knitting machine or to another guide bar that is constructed or organized differently.

In a simple case, the displacement function is provided as a two part curve for which the computer sequentially utilizes an overlap transition curve and an underlap transition curve.

A further simple alternative is provided where the displacement function is a three part curve for which. the computer utilizes one overlap transition curve and two underlap transition curves. By segmenting the underlap displacement into two transition curves, large displacement movement of the knock-over sinker required by the pattern may be avoided, or one can ensure that the threads are securely grasped by the sinker nose.

It is often useful for the computer to generate differently assembled displacement functions for each subsequent revolution of the main shaft: For example, for each even warp line, one can use one combination and for each odd warp line, the other combination, which can advantageously provide interesting patternings.

It is advantageous for the input arrangement to have a keyboard for the input of pattern data together with a conversion means which determines the appropriate characteristic data for each warp line from the pattern data. This simplifies the task of the service technician even further. It is for example, merely necessary to input a particular pattern type and the size of the thus selected patterned surface into the keyboard. The converter then transmits all of the characteristic data for the guide bar displacement.

In a further embodiment of the invention, the main shaft is provided with an absolute angular value transmitter, which for each rotational angle, transmits a different rotational angle signal to the output means. By utilizing this absolute value transmitter, the position target value is clearly and securely provided for a given angular position of the main shaft.

It is further advantageous that the angular signal of two successive revolutions of the main shaft are differentiable. In this further development, the position target values of the angular signals are clearly designated for not one but for two or more revolutions of the main shaft. It is possible to provide different displacement functions for successive main shaft revolutions and nevertheless be sure that the arrangement corresponds to the correct work cycle.

It is further to be desired that an absolute position transmitter is provided which generates a different actual position value for each position of the setting motor or guide bar, as well as a position control arrangement which generates a control signal for the deviation of the actual position value from the position target value. In this case, the absolute value transmitter ensures that on the output side, a clear indication of the position of the guide bar relative to the turning angle of the main shaft, is generated.

BRIEF DESCRIPTION OF THE DRAWINGS

The invention may be illustrated by the following drawings, which illustrate the preferred embodiments.

DETAILED DESCRIPTION OF THE PREFERRED EMBODIMENTS

Figure 1:
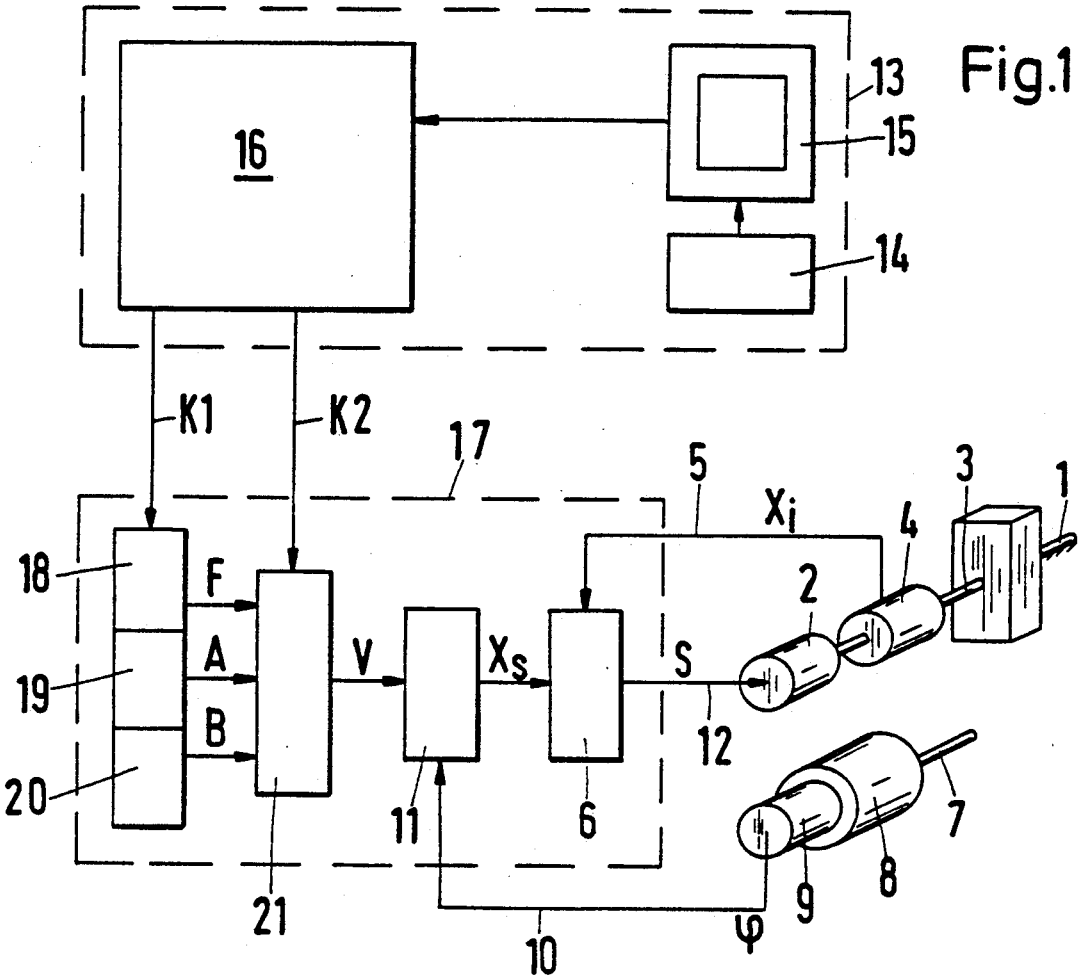
FIG. 1 is a schematic representation of the control arrangement of the present invention.

In the arrangement illustrated in FIG. 1, the setting motor 2 for the displacement of guide bar 1 is an electrical linear motor which operates via connecting push rod 3. An absolute position transmitter 4 provides the actual position value Xi which can be transmitted via line 5 to a position controller 6. Transmitter 4 may be a digital shaft encoder having a resolution appropriate for the desired accuracy.

The main shaft 7 of the warp knitting machine is driven by an electrical motor 8. An rotational angle transmitter 9 reports the appropriate rotational angle over line 10 to an output arrangement 11 which, in dependence upon the rotational angle signal transmits the position target value Xs to the position controller 6. In dependence upon the deviation between Xs and Xi, setting motor 2 is provided with the appropriate control signal S via line 12.

The other portions of the control arrangement serve to generate the position target value Xs. An input arrangement comprises a keyboard 14 connected to a monitor 15 and a converter 16 in the form of a pattern control computer. The characteristic data of a plurality of patterns are stored there. In a storage space of 1 megabyte, it is possible to store up to 200 patterns having up to 30,000 warp lines. By calling up a pattern number, the converter 16 provides the characteristic data K1 and K2 for the appropriate pattern to its output lines which are then further processed in the central operating unit 17, another computer.

This central unit 17 comprises a first storage section 18 which contains data corresponding to a plurality of prototype transition curves F for the overlap and underlap displacements of a guide bar. For example, section 18 may have data pairs (or tables) each containing a displacement value paired with a main shaft position value.

A second control section 19 contains data corresponding to compensation curves which take account of the displacement errors when a push rod (e.g., rod 3) is located between the setting motor 2 and the guide bar 1. For example, section 19 can have data pairs each containing a error value paired with either a guide bar position or a main shaft position.

A third storage section 20 contains the correction values which correspond to the expected deflection of the needles/guides caused by the thread forces. For example, section 20 can have data pairs each containing a correction value paired with either a guide bar position or a main shaft position. Alternatively, formulas may be contained in sections 18–20 to determine the functional relation between data. The three storage sections 18–20 may be formed by EPROMs and are easily interchangeable.

Based upon the characteristic data K1, the predetermined transition curves F that were chosen are transmitted to computer 21, here, the processor of a CPU (central processing unit). Computer 21 based upon the characteristic data K2 provided to it, calculates the displacement curve V, so that the size and direction of the displacement excursions are taken into account.

Where a push rod is present, second storage arrangement 19 provides a compensation curve A which is then combined with the transition curve F by addition or subtraction. Finally, from third storage section 20, correction values B can be introduced in the calculation of the displacement function.

From this combined displacement function, the corresponding position target value X. can be calculated in output arrangement 11 in dependence upon the angular position signal of line 10 from shaft encoder 9.

In actual practice, blocks 6, 11 and 21 need not be separate segments. Generally speaking, they can be combined into a single digital processor for commercial embodiments. This processor can be programmed with interrupt handlers that respond to increments in signals on lines 5 and 10. When signal Xi changes, signal Xs is adjusted based on the feedback function in arrangement 6 (e.g., a linear or integral function of (Xi−Xs)). When the signal on line 10 changes signal Xs is adjusted (e.g. by a look-up table formed in accordance with function F).

Figure 2:
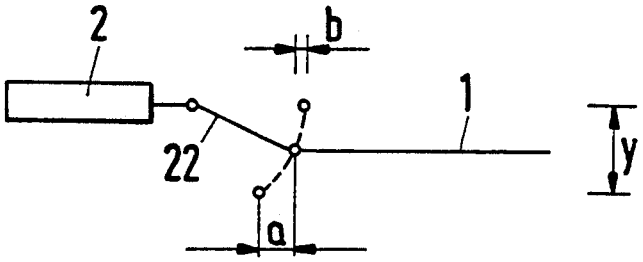
FIG. 2 shows the displacement error caused by a push rod driven guide bar.

FIG. 2 shows that a guide bar 1 when driven by a push rod 22 is subject to an axial displacement, solely via the influence of the swing through of bar 1 in direction Y. In the illustrated example, this displacement error has a value "a" in the lower reversal point and a value "b" in the other extreme, which must be taken into account.

Figure 3:
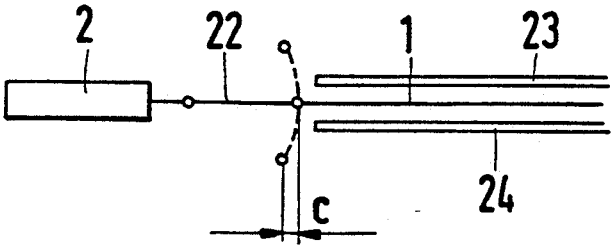
FIG. 3 shows a displacement error different from that shown in FIG. 2.

FIG. 3 illustrates a guide bar 1 driven by a push rod 22 operating with a double bedded warp knitting machine whose needle beds 23 and 24 are separated from each other. In even numbered main shaft rotations bed 23 and in uneven shaft rotations bed 24 are lapped about by stitches. Here, there is a displacement error which, because of the symmetrical arrangement, has the same value "c" in both reversal points, but this error occurs in the same direction. Where there are a plurality of guide bars for double bedded warp knitting machine, these unsymmetrical conditions lead to different displacement errors at the upper and lower reversal points, which must be taken into account.

Figure 4:
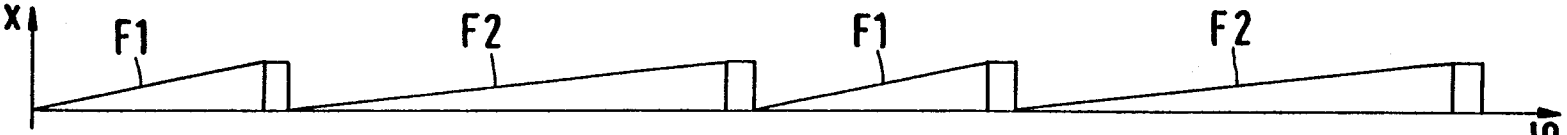
FIG. 4 shows the progress of a transition curve during two revolutions of the main shaft.

FIG. 4 illustrates an overlap transition curve F1 and an underlap transition curve F2, issuing from section 18. Curves F1 and F2 may be both stored by computer 16 in section 18 in the form of a combined look-up table correlating guide displacement to main shaft rotation. Curves Fl and F2 are combined to repeat with each revolution of the main shaft.

Figure 5:
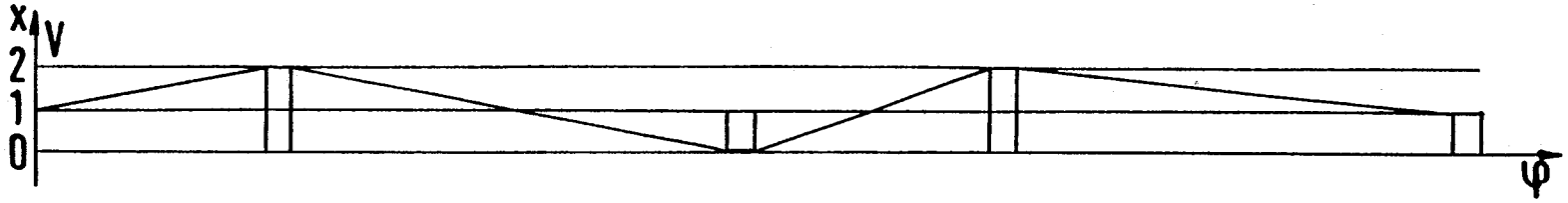
FIG. 5 is the displacement function generated from these transition curves.

From the curves of FIG. 4, it is possible to obtain the displacement function V of FIG. 5 wherein the computer 21 first directly uses the transition curve F1, multiplies the transition curve F2 by a factor of 2 and provides it with a negative sign and in the next knitting cycle scales up transition curve F1 by a factor of 2 and attaches the negative sign to transition curve F2 without rescaling.

Figure 6:
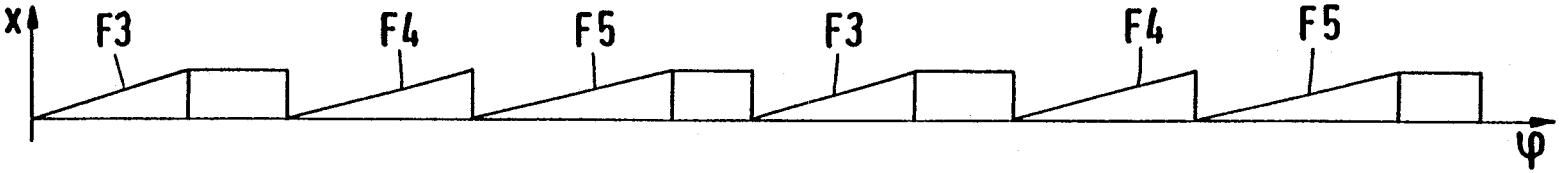
FIG. 6 shows the progress of three transition curves which are the same for successive main shaft rotations.

While the previous curves of FIG. 5 can be designated as two part curves, FIG. 6 illustrates three part curves. An overlap transition curve F3 (provided in a similar manner to curves F1 and F2) precedes a first underlap transition curve F4 and a second underlap transition curve F5. This three part pattern is repeated in the next knitting cycle. The three parts can be combined in a manner similar to that described for FIG. 5 to produce a displacement function. The different shapes of the two underlap transition curves F4 and F5 enable special effects to occur during the underlap, for example the penetration of a sinker through the thread sheet or the avoidance of collision with other operating components.

Figure 7:
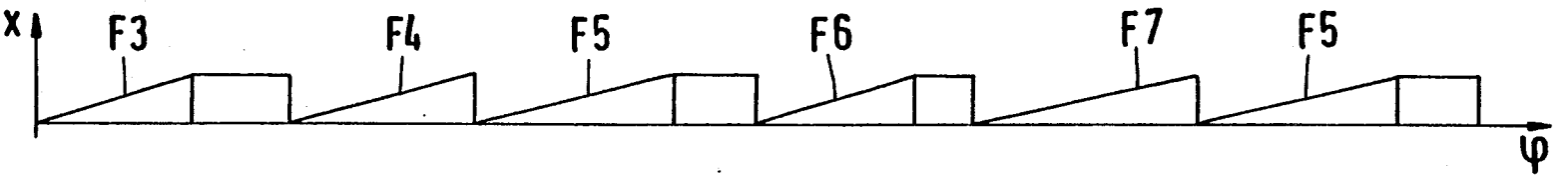
FIG. 7 shows the progress of three transition curves which are different in successive main shaft rotations.

In FIG. 7 the three transition curves in the first knitting cycle correspond to those in FIG. 6. In the second knitting cycle however, the first two transition curves are changed, namely overlap transition F6 and first underlap transition curve F7. These changes permit the development of a displacement function V in a manner similar to that illustrated in FIG. 5.

Figure 8:
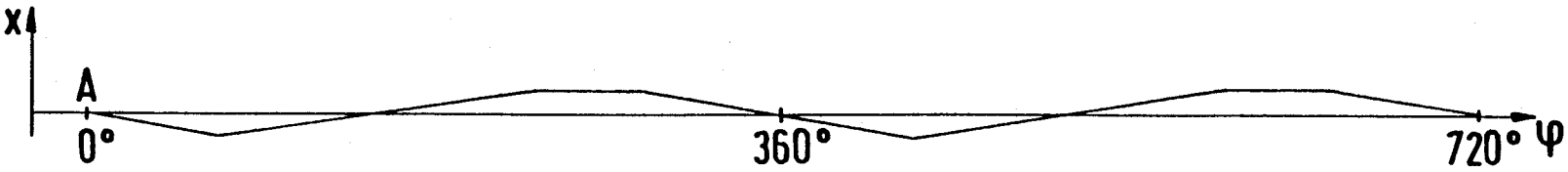
FIG. 8 is a compensatory function (substantially magnified) which takes account of a displacement error.

FIG. 8 shows a compensation curve A which operates to compensate for the push rod displacement error. It is derived from the transition curves F to produce a function that will correct the displacement function.

The correction values from the storage arrangement 20 can he handled in a manner similar to the values from arrangement 19.

The transition curves are here shown as straight lines. In practice however, we are dealing with very special curves which may be assembled from sinusoidal, parabolic, or hyperbolic segments, or a plurality of combinations thereof. The aim is to reduce acceleration or deceleration as much as possible.

We claim:

1. Control arrangement for the displacement of a guide bar of a warp knitting machine having a main shaft, comprising:

a setting motor for axially displacing said guide bar; and a schedule transmitter coupled to said main shaft for generating target lapping values for a displacement schedule, in response to angular displacement of said main shaft, said schedule transmitter being coupled to and operable to control said setting motor in accordance with said target lapping values, said schedule transmitter including:

(a) an input arrangement for providing a characteristic signal signifying characteristic data for a selected lapping pattern;

(b) a storage means having a first storage section for storing data signifying a selectable plurality of transition curves for regulating overlap and underlap displacements;

(c) a computer means coupled to said first storage section and responsive to said characteristic signal for processing sequentially data of at least two of the transition curves to form a displacement function providing displacement values related to revolution of said main shaft; and (d) an output arrangement coupled to said main shaft and said computer means for selecting said displacement values of the displacement function in response to angular rotation of the main shaft to provide said target lapping values.

2. Control arrangement according to claim 1 wherein said first storage section stores transition curves corresponding to displacement of one needle space, said computer means being operable to multiply data of said transition curves with integers selected in response to said characteristic signal.

3. Control arrangement in accordance with claim 1 and adapted to control said guide bar with said guide bar coupled to said setting motor through an articulating push rod, wherein said storage means comprises:

a second storage section for storing compensation data signifying at least one compensation curve relating displacement errors induced by said push rod, said computer being operable to adjust the displacement values of the displacement function in response to the compensation data of said compensation curve.

4. Control arrangement in accordance with claim 3, wherein said machine includes guides mounted on said guide bar and needles, said needles and said guides being relatively deflectable in response to thread forces, said storage means comprising:

a third storage section for storing correction values relating to cyclic deflection by said thread forces, said computer being operable to adjust the displacement function in response to said correction values in dependence on the characteristic signal.

5. Control arrangement in accordance with claim 1, wherein said storage means comprises:

at least one replaceable read only memory.

6. Control arrangement in accordance with claim 1 wherein the displacement function has two parts, said first storage section containing said two parts as an overlap transition curve and an underlap transition curve, said computer means being operable to sequentially process said overlap transition curve and said underlap transition curve.

7. Control arrangement in accordance with claim 1 wherein the displacement function has three parts, said first storage section containing said three parts as one overlap transition curve and two underlap transition curves, said computer means being operable to sequentially process said overlap transition curve and said two underlap transition curves.

8. Control arrangement in accordance with claim 7, wherein the computer means assembles said displacement functions differently for successive revolutions of the main shaft.

9. Control arrangement in accordance with claim 6 wherein the computer means assembles said displacement functions differently for successive revolutions of the main shaft.

10. Control arrangement in accordance with claim 1 wherein the input arrangement comprises:

a key pad and converter for providing pattern signals for setting said characteristic data, said characteristic data having information for defining each knitting course.

11. Control arrangement in accordance with claim 5 wherein the input arrangement comprises:

a key pad and converter for providing pattern signals for setting said characteristic data, said characteristic data having information for defining each knitting course.

12. Control arrangement in accordance with claim 6 wherein the input arrangement comprises:

a key pad and converter for providing pattern signals for setting said characteristic data, said characteristic data having information for defining each knitting course.

13. Control arrangement in accordance with claim 1 comprising:

an absolute rotation angle transmitter coupled to the main shaft and said output arrangement for providing to said output arrangement a varying rotation angle signal signifying varying angular rotation of said main shaft.

14. Control arrangement in accordance with claim 13 wherein the varying rotation angle signal can differentiate between two successive revolutions of said main shaft.

15. Control arrangement in accordance with claim 5 comprising:

an absolute rotation angle transmitter coupled to the main shaft and said output arrangement for providing to said output arrangement a varying rotation angle signal signifying varying angular rotation of said main shaft.

16. Control arrangement in accordance with claim 6 comprising:

an absolute rotation angle transmitter coupled to the main shaft and said output arrangement for providing to said output arrangement a varying rotation angle signal signifying varying angular rotation of said main shaft.

17. Control arrangement in accordance with claim 1 wherein said output arrangement comprises:

an absolute position transmitter responsive to motion of said setting motor and said guide bar for providing in response thereto a varying actual position value; and a position control arrangement for calculating the variation between said varying actual position value and said target lapping values.

18. Control arrangement in accordance with claim 2 wherein said output arrangement comprises:

an absolute position transmitter responsive to motion of said setting motor and said guide bar for providing in response thereto a varying actual position value; and a position control arrangement for calculating the variation between said varying actual position value and said target lapping values.

19. Control arrangement in accordance with claim 3 wherein said output arrangement comprises:

an absolute position transmitter responsive to motion of said setting motor and said guide bar for providing in response thereto a varying actual position value; and a position control arrangement for calculating the variation between said varying actual position value and said target lapping values.

* * * * *